US006447364B1

(12) United States Patent
Song

(10) Patent No.: US 6,447,364 B1
(45) Date of Patent: Sep. 10, 2002

(54) CONFETTI PROJECTOR

(76) Inventor: Youzhou Song, Suite 101, Building 1, Section 4 Longnanjingyuanxiaoqu, Ranghulu District, Daqing City, Heilongjiang Province P.R. 163712 (CN)

( * ) Notice: Subject to any disclaimer, the term of this patent is extended or adjusted under 35 U.S.C. 154(b) by 0 days.

(21) Appl. No.: 09/701,763

(22) PCT Filed: Mar. 31, 2000

(86) PCT No.: PCT/CN00/00070

§ 371 (c)(1),
(2), (4) Date: Dec. 1, 2000

(87) PCT Pub. No.: WO00/59597

PCT Pub. Date: Oct. 12, 2000

(30) Foreign Application Priority Data

| | | |
|---|---|---|
| Apr. 2, 1999 | (CN) | 99207097 U |
| Sep. 29, 1999 | (CN) | 99246092 U |
| Sep. 29, 1999 | (CN) | 99246095 U |
| Mar. 30, 2000 | (CN) | 00231792 U |

(51) Int. Cl.[7] ..... A63H 37/00

(52) U.S. Cl. ..... 446/475

(58) Field of Search ..... 446/475

(56) References Cited

U.S. PATENT DOCUMENTS

| | | | | |
|---|---|---|---|---|
| 5,149,290 | A | 9/1992 | Reveen | 446/475 |
| 5,338,242 | A | 8/1994 | Cheng | 446/220 |
| 5,529,527 | A | 6/1996 | Watkins | 446/475 |
| 5,620,355 | A | 4/1997 | Watkins | 446/475 |
| 5,634,840 | A | 6/1997 | Watkins | 446/475 |

FOREIGN PATENT DOCUMENTS

| | | |
|---|---|---|
| CN | 2252656 | 4/1997 |
| CN | 2259932 | 8/1997 |
| CN | 98209379.9 | 5/1999 |
| CN | 98232161.9 | 1/2000 |

*Primary Examiner*—John A. Ricci
(74) *Attorney, Agent, or Firm*—Collard & Roe, P.C.

(57) ABSTRACT

A confetti projector comprises a confetti-filled tube (1) and a pressurized air cylinder (2). Said cylinder (2) has only one passage as air's inlet and outlet. When a user rotates the tube (1) relatively to the cylinder (2) to a certain position, high-pressure air flows through the passage and into the tube (1), and the confetti is suddenly projected into the air.

10 Claims, 5 Drawing Sheets

CONFETTI PROJECTOR

CROSS REFERENCE TO RELATED APPLICATIONS

Applicants claim priority under 35 U.S.C. §119 of CHINESE Application No. 00 2 31782.6 filed on Mar. 30, 2000; CHINESE Application No. 99 2 46092.1 filed Sep. 29, 1999; CHINESE Application No. 99 2 46095.6 filed Sep. 29, 1999; and CHINESE Application No. 99 2 07097.X filed Apr. 2, 1999. Applicants also claim priority under 35 U.S.C. §120 of PCT/CN00/00070 filed on Mar. 31, 2000. The international application under PCT article 21(2) was not published in English.

FIELD OF THE INVENTION

The present invention relates to a confetti projector, and more particularly a confetti air projector.

BACKGROUND OF THE INVENTION

During grand celebrations, the Chinese people are accustomed to create a joyous atmosphere by setting off fireworks and firecrackers. However, setting off fireworks and firecrackers will cause great potential dangers not only to injure people but also to cause fire, so this kind of celebration method has been forbidden in some large and middle-sized cities of China. Therefore there is a need to find a succedaneum for fireworks and firecrackers.

A new Chinese utility model patent of Patent Code ZL98209379.9 has disclosed a type of confetti projector which could project kinds of colorful ribbons and colorful flakes into the air and produce a colorful confetti so as to create a joyous atmosphere. This projector greatly improves the safety, but it still uses powder to project, so it may still possibly cause some dangers. In addition, it will produce air pollution and will be unsuitable for indoor projection.

Another new Chinese utility model patent of Patent Code ZL98232161.9 has disclosed another confetti projector. It projects the confetti using pressurized air. Thus this projector improves safety greatly and produces no air pollution so that could be used both indoors and outdoors without any, safety care. The gas storage container of this projector has two passages respectively as air's inlet and outlet. The lower passage is used as air's inlet and the upper one is used as outlet. This projector may have the problem of leakage, so its storage life could not be very long. Meanwhile, its structure is complicated and it costs more.

The objective of this new practical invention is to provide a new type of confetti projector, which has little leakage, a long storage life and a simple structure.

SUMMARY OF THE INVENTION

The above mentioned objective is achieved by the following technical plan: the confetti projector has a confetti tube and a pressurized air cylinder. The confetti tube is filled with the articles used for forming confetti, and the air cylinder contains compressed air. There are a pair of L-form block notches outside of the cylinder opening. A press-slice blocks in the bottoms of the L-form block notches and presses upon the seal plug. There is a hole for air-inlet on the press slice. Outside of the above cylinder opening there is a tunable tube pusher which could push the press slice to turn. The above described tube pusher is connected to the confetti tube.

In the above plan, the press slice and tube pusher could be as the following structures: the central part of the press slice is round, and on both sides of the press slice there is respectively an "ear" part. The end of the "ear" part stretches out of the bottom of the L-form block notch. The described hole for air inlet lies in the middle of the press slice. There is respectively a longitudinal poker at either sides of each "ear" part end. Every poker is formed by the central part of the side wall of the tube pusher being turned over into the inside of the tube.

As a modification to the above plan, one "ear" part of the press slice could be linked to the inner wall of the confetti tube by an elastic linking string.

When the confetti projector is used, the above described confetti tube is made to rotate relatively to the air cylinder so that the so-called pusher could push the press slice to rotate. When the press slice rotates to the position of the vertical part of the L-form block notch, the pressure on the upper side of the slice suddenly vanishes, then the seal plug, the press slice and the articles in the confetti tube are projected by the compressed air in the air cylinder. Thus, the articles for confetti produce a colorful effect. The air inlet hole on the press slice is used to inlet the pressurized air into the air cylinder, so there is only one passage used as air inlet and outlet, which simplifies the structure and reduce the cost. Meanwhile, because there is only one passage, the leakage will be much less and the storage life will be greatly prolonged. The elastic linking string which links the press slice and the confetti tube could draw the ejected press slice back so as to prevent it from hurting people and to reuse it as well.

BRIEF DESCRIPTION OF THE DRAWINGS

This invention will be illustrated with the following drawings.

DETAILED DESCRIPTION OF THE INVENTION

Figure 1:
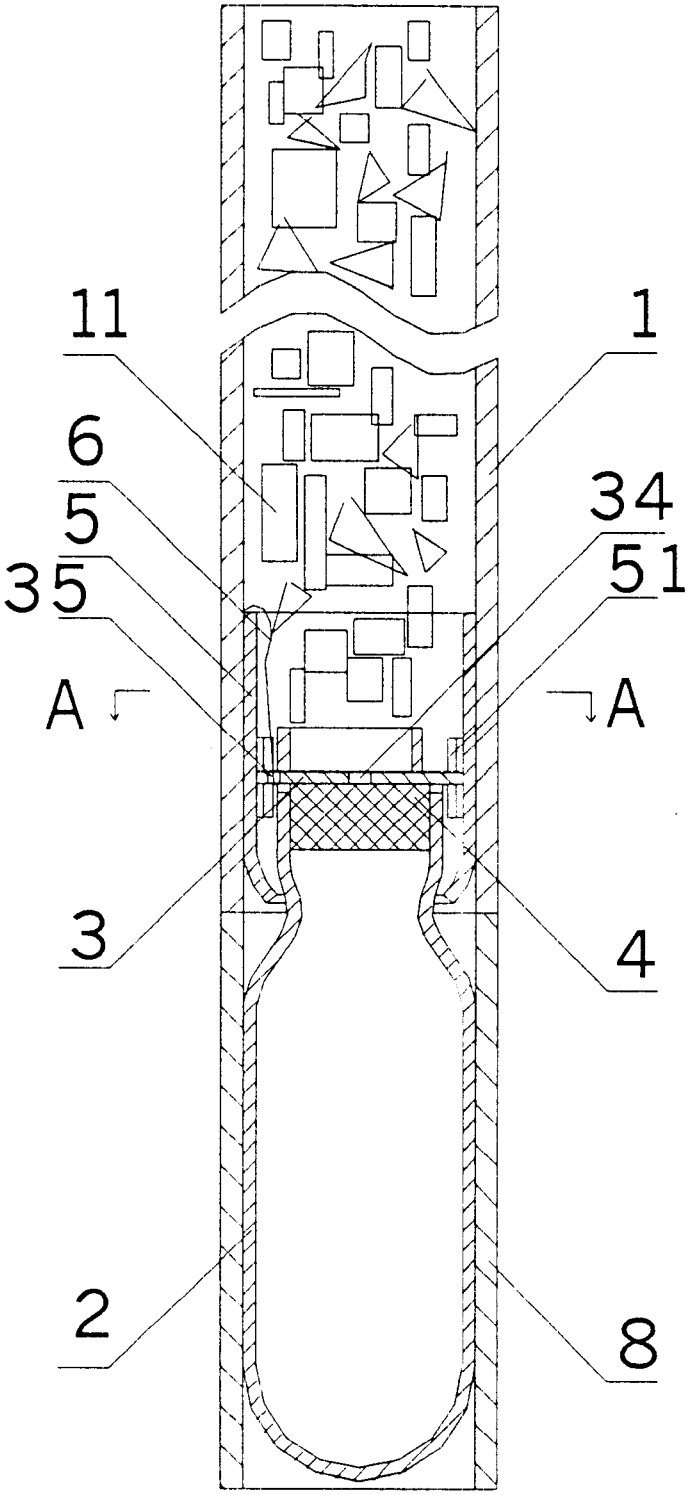
FIG. 1 shows the full perspective view of the confetti air projector of this invention.
Figure 2:
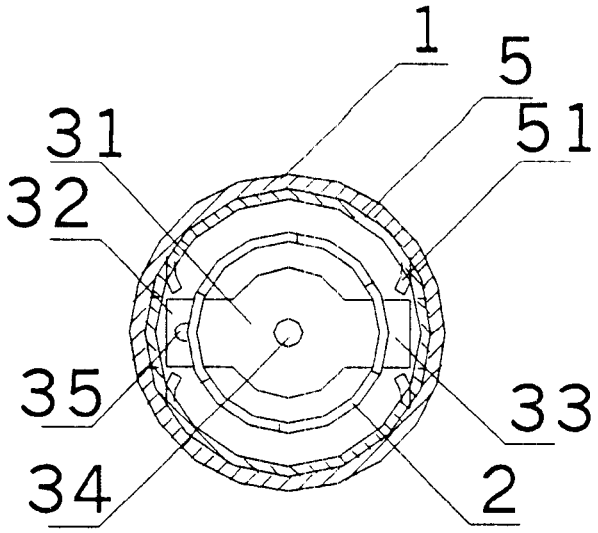
FIG. 2 represents the A—A cross sectional view of FIG. 1.

As shown in FIGS. 1 and 2, the confetti air projector of this invention has a confetti tube 1 and an air cylinder 2. The confetti tube is filled with the articles for confetti 11, and the air cylinder 2 is full of pressurized air. Outside of the air cylinder 2, there is a decorative tube 8.

Figure 3:
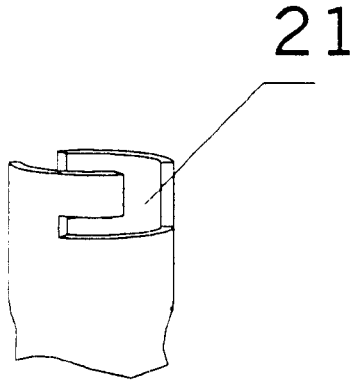
FIG. 3 presents the enlarged three-dimensional view of the cylinder opening of this confetti air projector.
Figure 4:
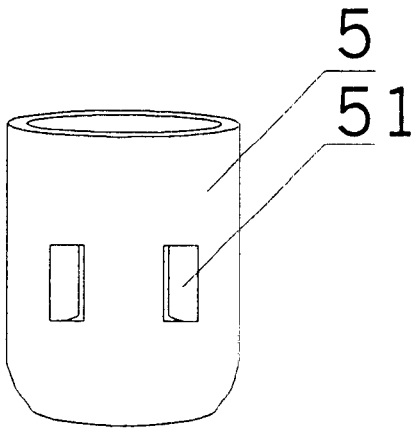
FIG. 4 shows the magnified three-dimensional view of the tube pusher in this new confetti air projector.

There are a pair of L-form block notches 21 outside of the cylinder 2 opening. The detailed shape of the block notch is shown in FIG. 3. A press slice 3 blocks into the bottoms of the L-form block notches 21 and presses upon the seal plug 4. The central part 31 of the press slice 3 is round, and on both sides of the press slice there is respectively an "ear" part 32, 33. The end of each "ear" part 32, 33 stretches out of the bottom of the L-form block notch 21. There is a hole as air inlet 34 in the middle of press slice 3; As shown in FIG. 4, on the outside of the above described cylinder opening there is a tunable tube pusher 5 which could be used for pushing the press slice 3 to turn; There is respectively a longitudinal poker 51 at either side of each "ear" part end. Each poker is formed by the central part of the side wall of the tube pusher being turned over into the inside of the tube. The above described tube pusher 5 is connected to the confetti tube 1. There is a linking hole 35 on each "ear" part 32 of the press slice 3. One end of an elastic linking string 6 is connected to the press slice 3 through the linking hole 35, while the other end is clipped between the tube pusher 5 and the confetti tube 1.

Figure 5:
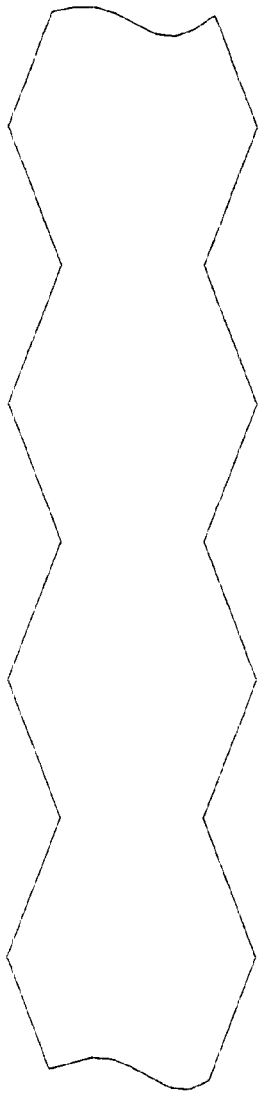
FIG. 5 illustrates the spread view of one kind of confetti rolls in this new confetti air projector.
Figure 6:
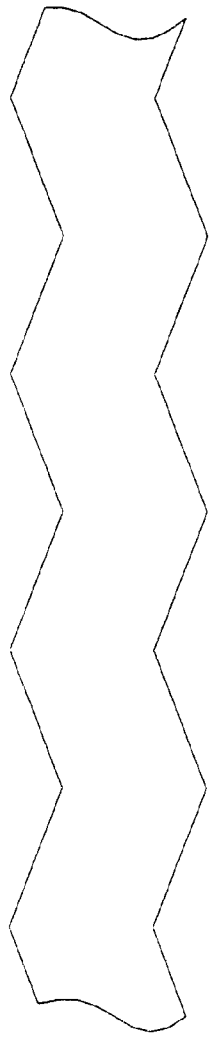
FIG. 6 shows the spread view of another type of confetti rolls in this new confetti air projector.
Figure 7:
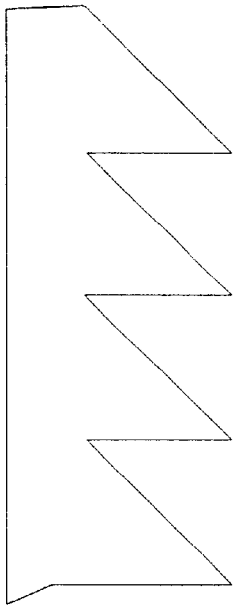
FIG. 7 represents the spread view of a third type of confetti rolls in this new confetti air projector.
Figure 8:
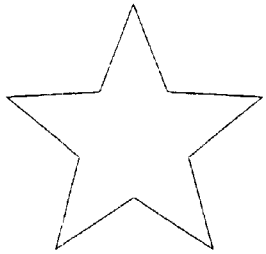
FIG. 8 presents the schematic view of a type of colorful pentagram paper pieces in this new confetti air projector.
Figure 9:
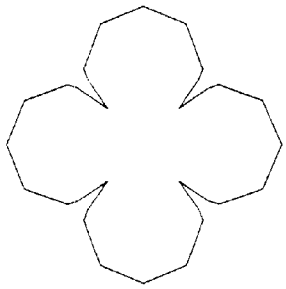
FIG. 9 shows the schematic view of a colorful paper piece with a plum blossom shape in this new confetti air projector.
Figure 10:
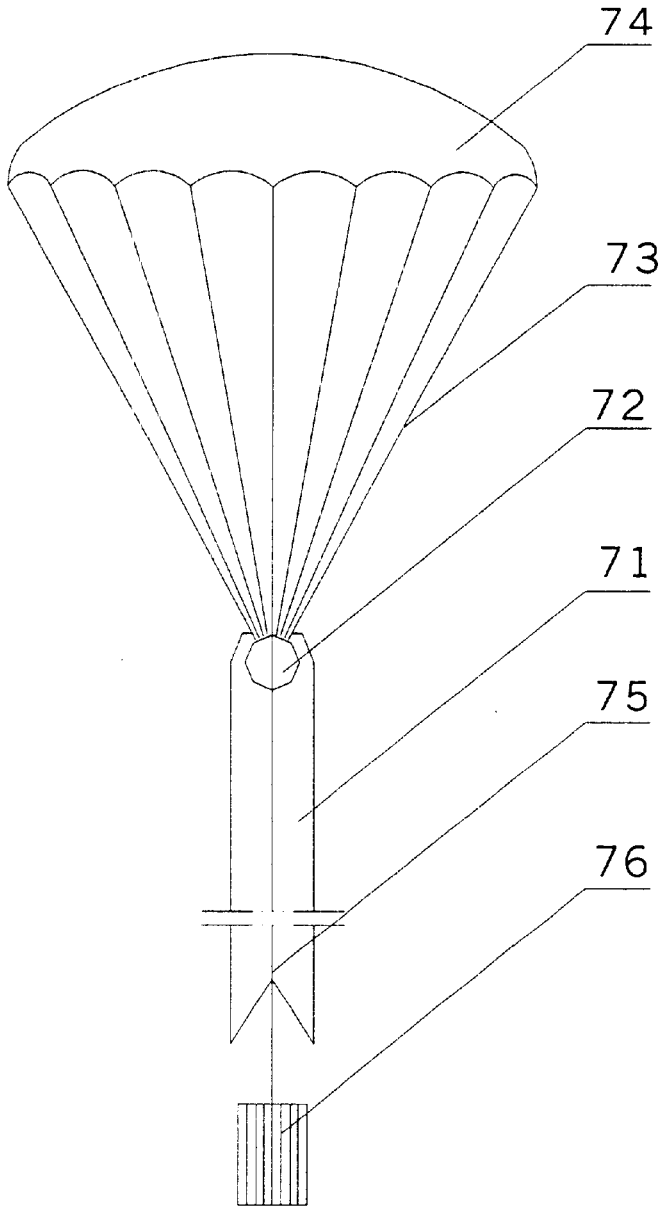
FIG. 10 describes the schematic view of a colorful parachute made of membrane in this new confetti air projector.

The confetti tube 1 could be filled with the required articles 11 used for producing confetti. The common articles are colorful paper pieces, colorful paper rings and confetti rolls. Among them, the confetti rolls could be colorful plastic film rolls as shown in FIG. 5 or 6. When this kind of plastic film rolls spread out in the air, their edges appear in saw-tooth form, which is more novel than common confetti forms. The plastic film roll could also be in the shape as shown in FIG. 7. It looks like continual flags when it spreads. The colorful paper pieces could be in the pentagram and plum blossom shapes as shown in FIGS. 8 and 9, as well as other shapes such as pigeon form, heart and the shapes of the Chinese characters "吉", "福" and "喜".. The confetti tube could also be filled with colorful membrane parachute as shown in FIG. 10. The parachute comprises a cap 74, strings 73, a pendant 72, a scroll 71, a rope 75 and an auxiliary pendant 76. Among them, the weight ratio of the cap to pendants is about 5:7, and the purpose of the auxiliary pendant is to make the parachute spread out completely.

It should be pointed out that, any common skilled people in this field may make various modifications and changes on this type of apparatus without departing from the scope of the utility patent as defined in the following claims.

What is claimed is:

1. A confetti air projector, comprising:

a confetti tube filled with articles for producing confetti;

an air storage cylinder connected to the confetti tube and full of pressurized air, said cylinder having an opening and a pair of L-form block notches outside of said opening;

a press slice for blocking into bottoms of the L-form block notches, said press slice having an air inlet hole;

a seal plug disposed within the air storage cylinder and pressed on by said press slice; and a turnable tube pusher on an outside of the cylinder opening and connected to the confetti tube, said tube pusher adapted for turning the press slice.

2. The confetti air projector according to claim 1, wherein the press slice has a round central part and has an ear part on two sides, wherein an end of each ear part stretches out of the bottom of the L-form block notch, wherein said air inlet is disposed in the middle of said press slice and wherein there is a longitudinal poker on either side of each ear part end, each poker being formed by a central part of a side wall of the tube pusher being turned over into an inside of the tube.

3. The confetti air projector of claim 2, wherein one ear part of the press slice is linked to the inner wall of the confetti tube by a linking string.

4. The confetti air projector according to claim 1, wherein the articles for producing confetti are comprised of colorful plastic film rolls.

5. The confetti air projector according to claim 4, wherein the plastic film rolls look like continuous flags when spread out.

6. The confetti air projector according to claim 1, wherein the articles for producing confetti are comprised of colorful membrane parachutes.

7. The confetti air projector according to claim 1, wherein the articles for producing confetti are comprised of colorful paper pieces.

8. The confetti air projector according to claim 7, wherein the colorful paper pieces are shaped like a pentagram.

9. The confetti air projector according to claim 7, wherein the colorful paper pieces are shaped like a plum blossom.

10. The confetti air projector according to claim 1, wherein the articles for producing the confetti are comprised of colorful paper rings.

* * * * *

UNITED STATES PATENT AND TRADEMARK OFFICE

CERTIFICATE OF CORRECTION

PATENT NO. : 6,447,364 B1
DATED : September 10, 2002
INVENTOR(S) : Y. Song

It is certified that error appears in the above-identified patent and that said Letters Patent is hereby corrected as shown below:

Title page,
Item [30], the last priority number correctly should read: -- 00231782 U --

Signed and Sealed this

Twentieth Day of May, 2003

JAMES E. ROGAN
*Director of the United States Patent and Trademark Office*